US009329551B2

(12) United States Patent
Yuasa

(10) Patent No.: US 9,329,551 B2
(45) Date of Patent: May 3, 2016

(54) MEDIUM CASSETTE AND IMAGE FORMING APPARATUS

(71) Applicant: OKI DATA CORPORATION, Tokyo (JP)

(72) Inventor: Hiroshi Yuasa, Tokyo (JP)

(73) Assignee: OKI DATA CORPORATION, Tokyo (JP)

( * ) Notice: Subject to any disclaimer, the term of this patent is extended or adjusted under 35 U.S.C. 154(b) by 0 days.

(21) Appl. No.: 14/333,541

(22) Filed: Jul. 17, 2014

(65) Prior Publication Data

US 2015/0023710 A1 Jan. 22, 2015

(30) Foreign Application Priority Data

Jul. 22, 2013 (JP) ..... 2013-151737

(51) Int. Cl.
*B65H 1/00* (2006.01)
*G03G 15/00* (2006.01)
*B65H 1/04* (2006.01)

(52) U.S. Cl.
CPC ..... *G03G 15/6502* (2013.01); *B65H 1/04* (2013.01); *B65H 2701/113* (2013.01); *B65H 2701/1131* (2013.01)

(58) Field of Classification Search
CPC ..... B65H 2701/113; B65H 2701/1131
See application file for complete search history.

(56) References Cited

U.S. PATENT DOCUMENTS 5,611,528 A * 3/1997 Nakamura et al. ..... 271/164
8,128,084 B2 * 3/2012 Kitayama ..... 271/171

FOREIGN PATENT DOCUMENTS

| | | | |
|---|---|---|---|
| JP | H06-82053 | U | 11/1994 |
| JP | H07-206170 | A | 8/1995 |
| JP | H11-139573 | A | 5/1999 |
| JP | 2000-136033 | A | 5/2000 |
| JP | 2006-008351 | A | 1/2006 |
| JP | 2010-052858 | A | 3/2010 |

* cited by examiner

*Primary Examiner* — Howard Sanders
(74) *Attorney, Agent, or Firm* — Kubotera & Associates, LLC

(57) ABSTRACT

A medium cassette is configured to be held and attached to a main body of an image forming apparatus so that the medium cassette slides in an insertion direction or a pullout direction relative to the image forming apparatus. The medium cassette includes a rear side guide for guiding a medium to be placed at a rear side in the pullout direction; a locking member disposed to be able to engage with a body of the medium cassette for regulating a position of the rear side guide relative to the body of the medium cassette; and a movement conversion member for converting a movement of the rear side guide generated by an impact when the medium cassette is attached to the body of the image forming apparatus to a movement of the locking member in a direction that the locking member engages with the body of the medium cassette.

9 Claims, 9 Drawing Sheets

MEDIUM CASSETTE AND IMAGE FORMING APPARATUS

BACKGROUND OF THE INVENTION AND RELATED ART STATEMENT

The present invention relates to a medium cassette for placing a medium to be supplied to an image forming apparatus, and to an image forming apparatus having the medium cassette.

A conventional image forming apparatus configured to perform a color printing operation or a monochrome printing operation is provided with a sheet cassette for placing a recording sheet to be printed. A regulating member is disposed in the sheet cassette for regulating a position of the recording sheet laterally and longitudinally, thereby securing printing position accuracy. The sheet cassette is configured such that the regulating member is not easily shifted (refer to Patent Reference).

Patent Reference: Japanese Patent Publication No. 2010-52858

In the conventional image forming apparatus disclosed in Patent Reference, when a maximum amount of sheets are placed in the sheet cassette, and the sheet cassette is attached to the conventional image forming apparatus, a large force may be applied to the regulating member. In this case, the regulating member may be shifted from a regular position. In order to prevent the regulating member from being shifted from the regular position, it may be configured such that the regulating member is attached to the sheet cassette with a relatively large force. However, in this case, a handling property such as adjusting the position of the regulating member may be suffered.

In view of the problems described above, an object of the present invention is to provide an image forming apparatus capable of securely maintaining a position of a regulating member without suffering the handling property of the regulating member even when a large impact is applied to the regulating member.

Further objects and advantages of the invention will be apparent from the following description of the invention.

SUMMARY OF THE INVENTION

In order to attain the objects described above, according to an aspect of the present invention, a medium cassette is configured to be held and attached to a main body of an image forming apparatus so that the medium cassette slides in an insertion direction or a pullout direction relative to the image forming apparatus.

According to the aspect of the present invention, the medium cassette includes a rear side guide for guiding a medium to be placed at a rear side in the pullout direction; a locking member disposed to be able to engage with a body of the medium cassette for regulating a position of the rear side guide relative to the body of the medium cassette; and a movement conversion member for converting a movement of the rear side guide generated by an impact when the medium cassette is attached to the main body of the image forming apparatus to a movement of the locking member in a direction that the locking member engages with the body of the medium cassette.

According to the aspect of the present invention, it is possible to hold the locking member with an enhanced force against an impact applied to the rear side guide when the medium cassette is attached to the main body of the image forming apparatus. Accordingly, it is not necessary to increase a locking force of the locking member, and to improve the handling property of the medium cassette such as adjusting a position thereof.

DETAILED DESCRIPTION OF PREFERRED EMBODIMENTS

Hereunder, embodiments of the present invention will be explained with reference to the accompanying drawings. It should be noted that the present invention is not limited to the following description, and the embodiments can be modified within a scope of the present invention.

First Embodiment

Figure 1:
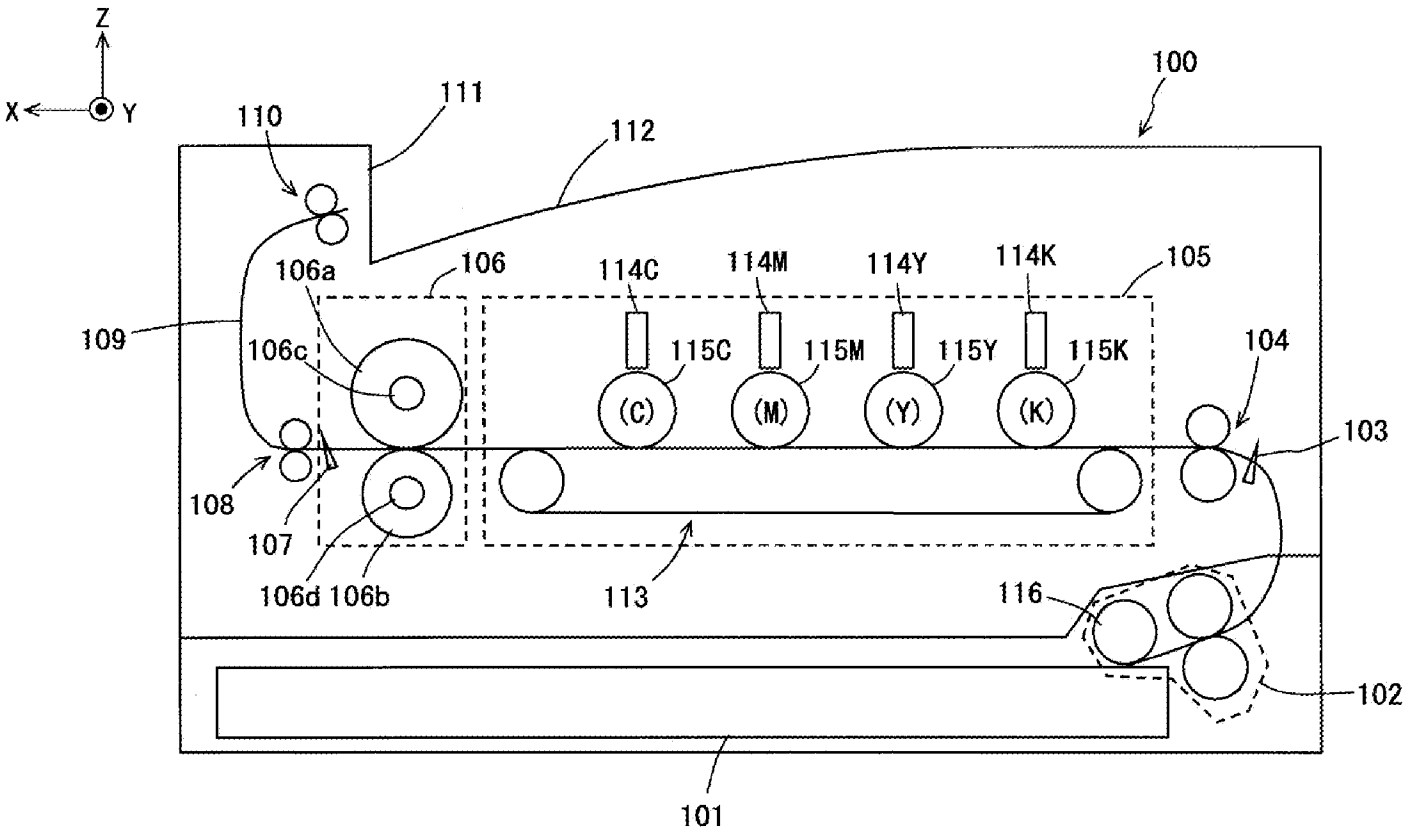
FIG. 1 is a schematic sectional view showing a configuration of an image forming apparatus with a sheet cassette disposed therein according to a first embodiment of the present invention.

A first embodiment of the present invention will be explained. FIG. 1 is a schematic sectional view showing a configuration of an image forming apparatus 100 with a sheet cassette 101 disposed therein according to the first embodiment of the present invention.

As shown in FIG. 1, the sheet cassette 101 as a medium cassette capable of placing a recording sheet as a medium in a stacked state is disposed at a lower portion of the image forming apparatus 100 having a configuration of an electrophotographic printer. More specifically, the sheet cassette 101 is held in and attached to a main body of the image forming apparatus 100 to be slidable, so that the sheet cassette 101 can be pulled out in a front direction (a front side in FIG. 1, or a Y axis plus direction; described later). A configuration of the sheet cassette 101 will be explained later in more detail.

In the first embodiment, the image forming apparatus 100 includes a sheet supply portion 102 to be driven with a driving unit (not shown) and a print timing adjusting portion 104. The sheet supply portion 102 is provided for drawing out the recording sheets placed in the sheet cassette 101 one by one from the uppermost sheet, and for transporting the recording sheet to the print timing adjusting portion 104 along a sheet transportation path. Further, the image forming apparatus 100 includes a sheet detecting portion 103 disposed on an upstream side of the print timing adjusting portion 104 in a sheet transportation direction. The sheet detecting portion 103 is provided for detecting the recording sheet passing there through, so that the sheet detecting portion 103 detects that the recording sheet is supplied to the print timing adjusting portion 104.

In the first embodiment, the image forming apparatus 100 further includes an image forming portion 105. The image forming portion 105 includes a photosensitive drum 115B for forming a toner image in black (B); a photosensitive drum 115B for forming a toner image in yellow (Y); a photosensitive drum 115M for forming a toner image in magenta (M); and a photosensitive drum 115B for forming a toner image in cyan (C). It should be noted that the photosensitive drum may be collectively referred to as the photosensitive drum 115 if it is not necessary to differentiate a color). The photosensitive drums 115 are arranged along the sheet transportation path from the upstream side in the sheet transportation direction to form the sheet transportation path in a linear shape.

In the first embodiment, the image forming portion 105 further includes an LED (Light Emitting Diode) head 114K disposed near the photosensitive drum 115K for exposing the photosensitive drum 115K to form a static latent image according to image data. Similarly, in the image forming portion 105, an LED head 114Y is disposed near the photosensitive drum 115Y; an LED head 114M is disposed near the photosensitive drum 115M; and an LED head 114C is disposed near the photosensitive drum 115C, respectively. After the LED heads 114K, 114Y, 114M, and 114C form the static latent images in each color on the photosensitive drums 115, a developing device (not shown) develops the static latent images to form toner images.

In the first embodiment, the image forming apparatus 100 further includes a transfer belt unit 113 and a fixing device 106 disposed on the downstream side of the transfer belt unit 113. The transfer belt unit 113 is provided for transporting the recording sheet transported from the print timing adjusting portion 104, so that the toner images formed on the photosensitive drums 115 are sequentially overlapped and transferred to the recording sheet while the recording sheet passes through the photosensitive drums 115. Accordingly, synchronizing with the print timing adjusting portion 104, the image forming portion 105 forms the toner images. Further, together with the transfer belt unit 113, the image forming portion 105 transports the recording sheet with the toner image overlapped and transferred thereon to the fixing device 106.

In the first embodiment, the fixing device 106 includes a transfer roller 106*a* with a heating heater 106*c* disposed therein and a pressing roller 106*b* with a heating heater 106*d* disposed therein. The transfer roller 106*a* is arranged to abut against the pressing roller 106*b* with a specific pressing force while rotating, so that the tonner images thus transferred are pressed and heated. Then, the fixing device 106 transports the recording sheet toward the downstream side. A transportation detecting unit 107 is provided for detecting the recording sheet after the fixing device 106 fixes the toner images to the recording sheet.

In the first embodiment, the image forming apparatus 100 further includes a transportation roller pair 108, a discharge transportation path 109, a discharge roller pair 110, and a stacker 112. The transportation roller pair 108 is driven with a drive source (not shown) for transporting the recording sheet with the toner images fixed thereto to the discharge transportation path 109. The discharge roller pair 110 is driven with a drive source (not shown) for discharging the recording sheet transported through the discharge transportation path 109 to the stacker 112.

It should be noted that an X axis in FIG. 1 represents the transportation direction of the recording sheet when the recording sheet passes through the photosensitive drums 115K, 115Y, 115M and 115C. Further, a Y axis in FIG. 1 is aligned with a rotational axis of each of the photosensitive drums 115K, 115Y, 115M and 115C, and a Z axis represents a direction perpendicular to the Y axis. It also should be noted that the X axis, the Y axis, and the Z axis shown in the other drawings are the same as those in FIG. 1. In other words, the X axis, the Y axis, and the Z axis represent a placement direction of components shown in the other drawings in the image forming apparatus 100 shown in FIG. 1. Further, it should be noted that the Z axis is also aligned with a vertical direction.

Figure 2:
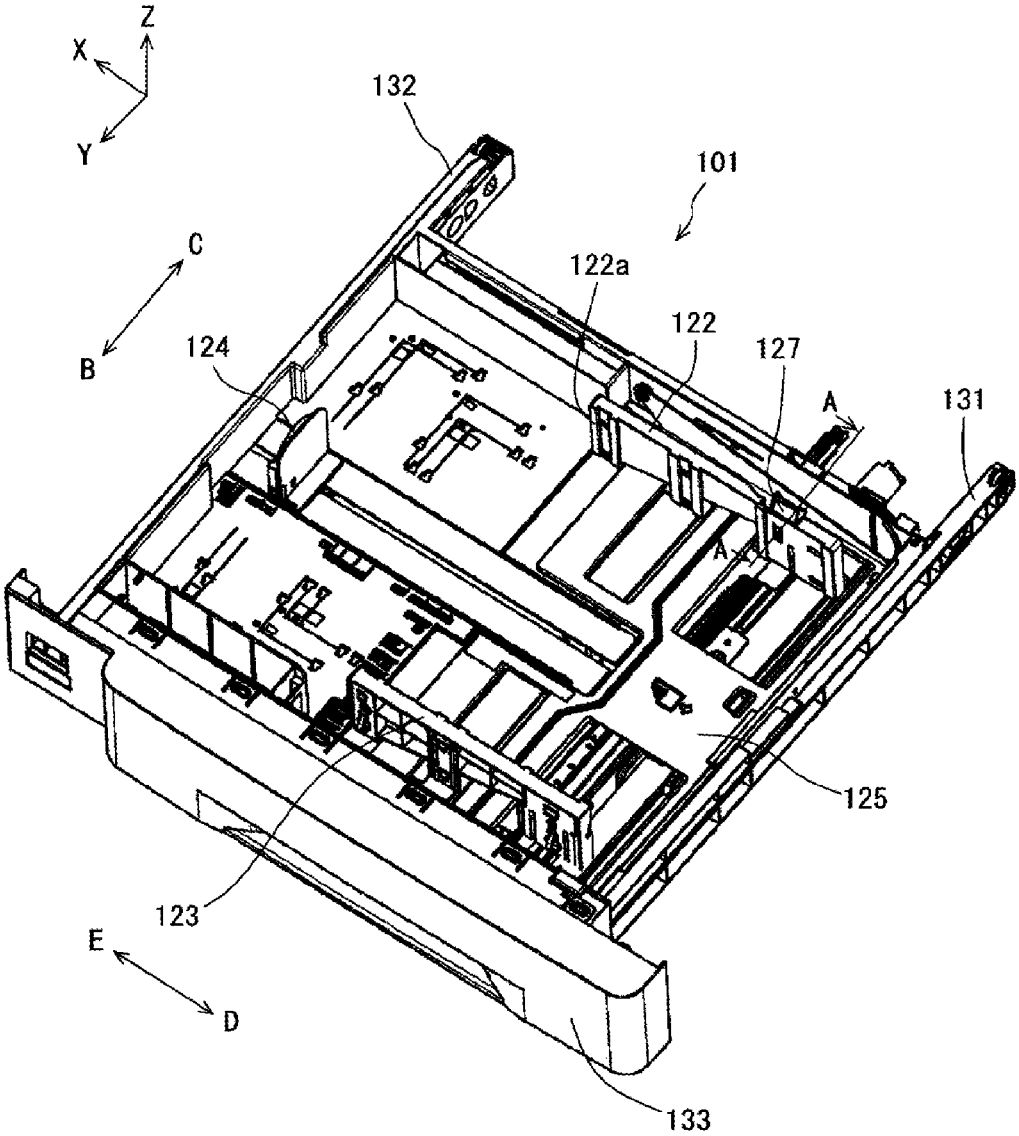
FIG. 2 is a schematic perspective view showing the sheet cassette of the image forming apparatus according to the first embodiment of the present invention.
Figure 3:
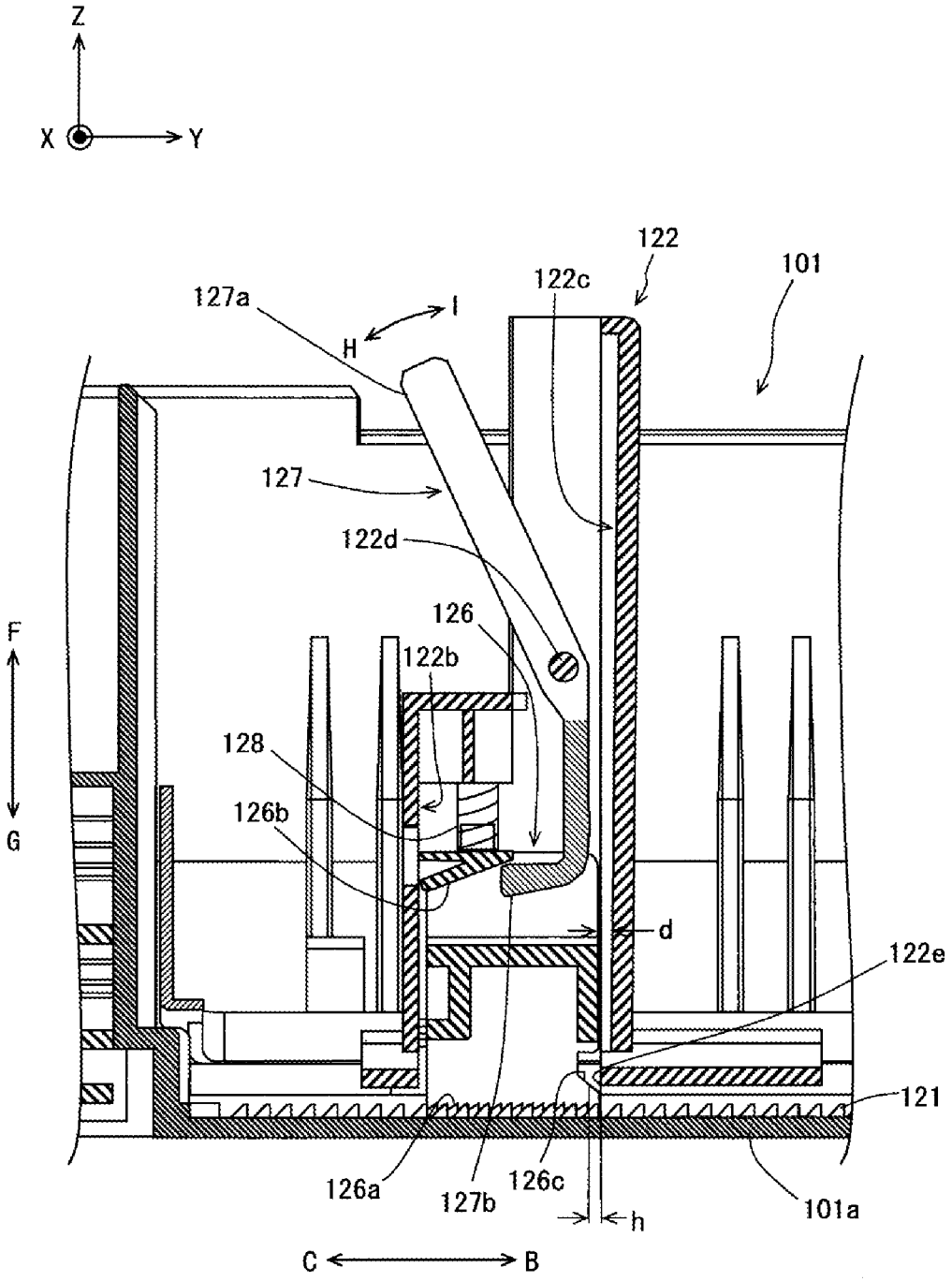
FIG. 3 is a schematic sectional view showing the sheet cassette of the image forming apparatus taken along a line A-A in FIG. 2 according to the first embodiment of the present invention.

FIG. 2 is a schematic perspective view showing the sheet cassette 101 of the image forming apparatus 100 according to the first embodiment of the present invention. FIG. 3 is a schematic sectional view showing the sheet cassette 101 of the image forming apparatus 100 taken along a line A-A in FIG. 2 according to the first embodiment of the present invention.

As shown in FIG. 2, the sheet cassette 101 includes a right guide rail 131 and a left guide rail 132. When the sheet cassette 101 is attached and disposed at the lower portion of the image forming apparatus 100 as shown in FIG. 1, the right guide rail 131 and the left guide rail 132 are inserted into guide grooves formed inside the image forming apparatus 100. Accordingly, the sheet cassette 101 is retained in the image forming apparatus 100 to be slidable in an arrow direction C (the Y axis direction) indicating an insertion direction and an arrow direction B (the Y axis direction) indicating a pullout direction. Further, the sheet cassette 101 is attached and situated at an attachment position defined at an edge portion in the insertion direction, so that the sheet supply portion 102 is capable of drawing out the recording sheet. It should be noted that components of the image forming apparatus 100 may be referred to as a main body of the image forming apparatus 100 except detachable components and movable components such as the sheet cassette 101.

As shown in FIG. 2, the sheet cassette 101 is formed in a flat box shape having an upper opening portion, so that the recording sheet can be placed therein from above. The sheet cassette 101 includes a rear side guide 122 for guiding a rear side of the recording sheet to be placed in the pullout direction of the sheet cassette 101 (the arrow direction B); a front side guide 123 for guiding a front side of the recording sheet in the arrow direction B; a rear edge guide 124 for guiding a rear edge of the recording sheet; and a sheet placing plate 125 for placing a half portion of the recording sheet on a pullout side of the recording sheet (an arrow direction D).

In the first embodiment, the sheet cassette 101 is configured such that the recording sheet is transported in the arrow direction D (a negative direction of the X axis) or a transportation direction thereof. When the sheet cassette 101 is attached to the image forming apparatus 100, the sheet placing plate 125 is arranged to presses the recording sheets, so that an uppermost sheet of the recording sheets abuts against a pickup roller 116 of the sheet supply portion 102 (refer to FIG. 1).

In the first embodiment, a main body of the sheet cassette 101 holds the rear edge guide 124 such that the rear edge guide 124 can slide in the X axis direction. Further, the main body of the sheet cassette 101 holds the rear side guide 122 and the front side guide 123 such that the rear side guide 122 and the front side guide 123 can slide in the Y axis direction, respectively. Further, the rear side guide 122, the front side guide 123 and the front side guide 123 are arranged such that the rear side guide 122, the front side guide 123 and the front side guide 123 can be locked at desirable slide positions if necessary, respectively.

A locking mechanism of the rear side guide 122 will be explained next. As shown in FIG. 2, the rear side guide 122 has a specific width in the X axis direction. Further, the rear side guide 122 includes six of regulating surfaces 122*a* having a rectangular shape and disposed over an entire width region. The regulating surfaces 122*a* are formed on a guide side of the rear side guide 122 opposite to the recording sheets to be placed. The regulating surfaces 122*a* protrude with a common flash surface and extend in the vertical direction, so that the regulating surfaces 122*a* abut against the recording sheets. An operation lever 127 is disposed on a side the transportation direction (the arrow direction D) relative to a width center of the rear side guide 122.

FIG. 3 is a schematic sectional view showing the sheet cassette of the image forming apparatus taken along a line A-A in FIG. 2 passing through the operation lever 127 (a positive side of the X axis) according to the first embodiment of the present invention.

As shown in FIG. 3, the main body of the sheet cassette 101 holds the rear side guide 122 to be slidable in the arrow direction C and the arrow direction B (the Y axis direction), and includes a bottom surface 101*a*. Further, a rack 121 is formed on the bottom surface 101*a*, and includes a teeth portion with a specific pitch p1 (refer to FIG. 5(*a*)) arranged in the arrow direction C and the arrow direction B (the Y axis direction).

In the first embodiment, the rear side guide 122 includes a lock member 126 on an opposite side to the guide side where the regulating surfaces 122*a* are formed (refer to FIG. 2). The lock member 126 is integrally formed of an engaging portion 126*a* disposed at a lower portion thereof and an application surface 126*b* disposed at an upper portion thereof. Further, the rear side guide 122 is configured to hold the lock member 126 with a guide portion formed of a guide surface 122*b* at the rear side thereof and a guide surface 122*c* at the front side thereof, so that the lock member 126 can slide in an arrow direction F and an arrow direction G, that is, the vertical direction.

In the first embodiment, a small attachment gap (a play amount d) is formed between the guide surface 122*b* and the guide surface 122*c*, and the lock member 126 in the arrow direction B and the arrow direction C. It should be noted that the lock member 126 abuts against the guide surface 122*b* at the rear side in the state shown in FIG. 3. Accordingly, the small attachment gap (the play amount d) corresponds to a gap amount between the lock member 126 and the guide surface 122C on the rear side.

In the first embodiment, a coil spring 128 is disposed between the main body of the rear side guide 122 and the lock member 126 in a compressed state, so that the coil spring 128 urges the lock member 126 in an arrow direction G (a downward direction). Accordingly, the rack 121 disposed on the main body of the sheet cassette 101 engages with the engaging portion 126*a* of the lock member 126, so that the lock member 126 is locked to the main body of the sheet cassette 101. As a result, the main body of the rear side guide 122 is restricted in a movement thereof within the play amount d (the small attachment gap).

Figure 5A:
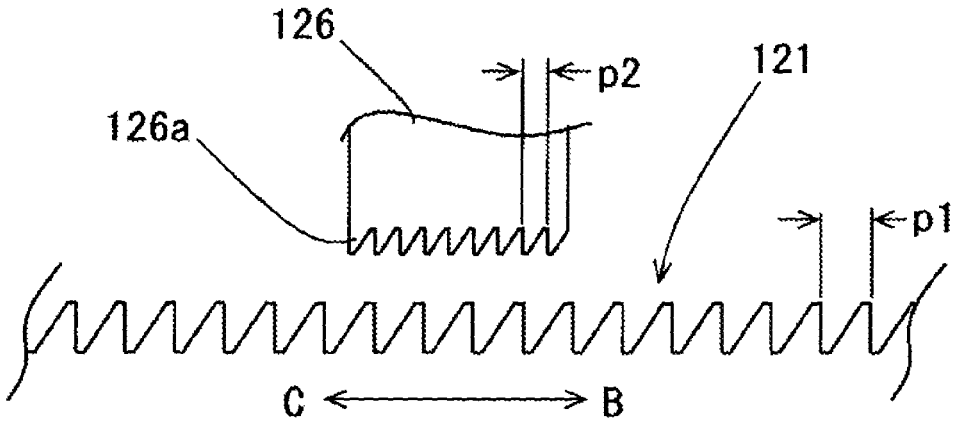
FIGS. 5(*a*) and 5(*b*) are schematic side views showing the operation of a rear side guide of the sheet cassette of the image forming apparatus according to the first embodiment of the present invention, wherein FIG. 5(*a*) is a schematic side view when a rack of the rear side guide is disengaged from an engaging portion of the sheet cassette, and FIG. 5(*b*) is a schematic side view when the rack of the rear side guide engages with the engaging portion of the sheet cassette.
Figure 5B:
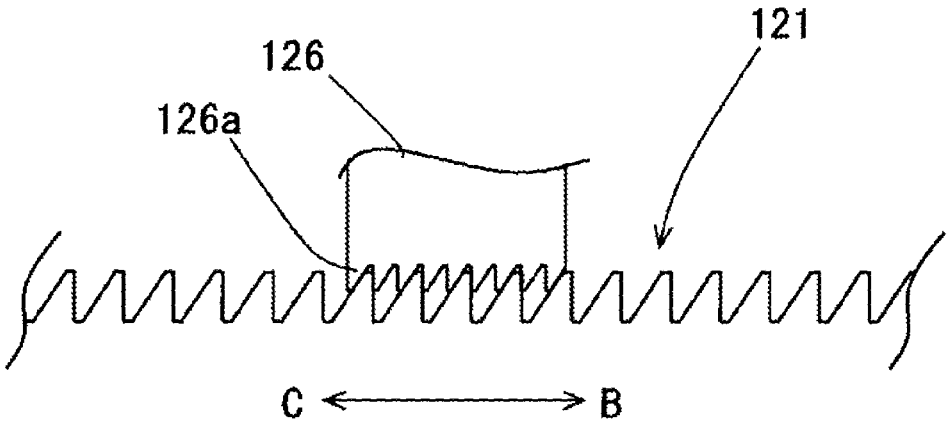

A positional relationship between the rack 121 and the engaging portion 126*a* of the lock member 126 will be explained next. FIGS. 5(*a*) and 5(*b*) are schematic side views showing the operation of the rear side guide 122 of the sheet cassette 101 of the image forming apparatus 100 according to the first embodiment of the present invention. More specifically, FIG. 5(*a*) is a schematic side view when the rack 121 of the rear side guide 122 is disengaged from the engaging portion 126*a* of the sheet cassette 101, and FIG. 5(*b*) is a schematic side view when the rack 121 of the rear side guide 122 engages with the engaging portion 126*a* of the sheet cassette 101.

As shown in FIGS. 5(*a*) and 5(*b*), the engaging portion 126*a* has teeth with a pitch p2, and the rack 121 has teeth with a pitch p1. It should be noted that the pitch p2 is set to be a half of the pitch p1. Accordingly, when the lock member 126 engages with the rack 121 as shown in FIG. 5(*b*), it is possible to position the lock member 126 with the accuracy corresponding to the pitch p2 of the lock member 126 in the arrow direction B and the arrow direction C.

In the first embodiment, the rear side guide 122 further includes the operation lever 127 capable of engaging with the lock member 126, and the operation lever 127 is supported with a rotational axis 122*d* thereof to be freely rotatable. The operational lever 127 includes an operation portion 127*a* and an application portion 127*b*. When the operation lever 127 is supported to be freely rotatable in an initial state shown in FIG. 3, the operation portion 127*a* extends obliquely and upwardly from the rotational axis 122*d*, and the application portion 127*b* extends downwardly from the rotational axis 122*d*. The application portion 127*b* is formed to bend at a middle portion thereof, so that the application portion 127*b* can engage with the application surface 126*b* of the lock member 126 from below.

In the first embodiment, when an operator operates and rotates the operation portion 127*a* of the operation lever 127 in an arrow direction I while the rear side guide 122 is in the initial state shown in FIG. 3, the operation lever 127 is rotated in the arrow direction I, so that the application portion 127*b* of the operation lever 127 pushes the application surface 126*b* of the lock member 126 from below. Accordingly, the lock member 126 is pushed upwardly (an arrow direction F) against the urging force of the coil spring 128. As a result, as shown in FIG. 5(*a*), the engaging portion 126*a* of the lock member 126 is disengaged from the rack 121.

Accordingly, from this state, when the operator moves the rear side guide 122 to a desirable position along the arrow direction B and the arrow direction C, and releases the operation lever 127, the engaging portion 126*a* of the lock member 126 engages with the rack 121 once again. As a result, it is possible to lock the lock member 126 at the desirable position, and restrict the movement of the rear side guide 122 within the play amount d (the small attachment gap) at the desirable position.

In the first embodiment, the lock member 126 includes a recessed portion having an abutting inclined surface 126*c* on a side portion thereof on the pullout side (the arrow direction B) at a position near the engaging portion 126*a*. The abutting inclined surface 126*c* is formed to incline in the arrow direction C (the opposite direction to the arrow direction B) from below toward upward. Further, the rear side guide 122 includes an abutting portion 122*e* on the front side thereof at a lower portion of the guide surface 122*c*. The abutting portion 122*e* is arranged to face and be able to abut against the abutting inclined surface 126*c*.

In the first embodiment, as explained above, the abutting portion 122*e* is arranged to be able to abut against the abutting inclined surface 126*c* at an abutting position thereof. A maximum distance h is set between the abutting portion 122*e* and the abutting position of the abutting inclined surface 126*c*, and it is configured such that the maximum distance h becomes substantially equal to or slightly smaller than the play amount d (the small attachment gap). It should be noted that the abutting portion 122*e* and the abutting inclined surface 126*c* correspond to a movement conversion member.

In the first embodiment, it is preferable that the abutting inclined surface 126*c* is inclined at an inclination angle of about 40° to 45° (the inclination angle is 45° in the first embodiment). Further, it is preferable that the maximum distance h is set to be smaller than the pitch p2 of the engaging portion 126*a* that corresponds to the positional accuracy of the lock member 126.

Figure 4:
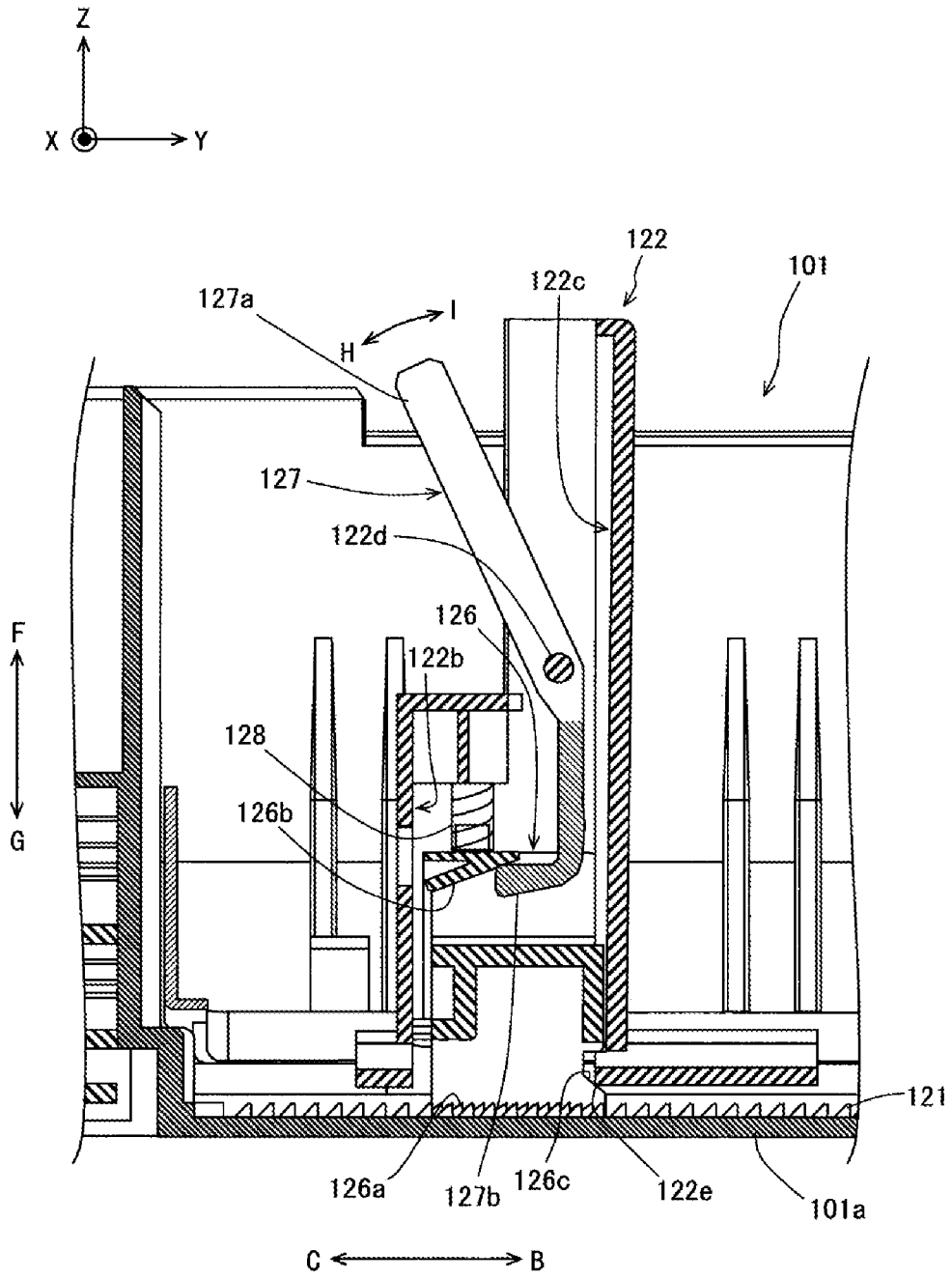
FIG. 4 is a schematic sectional view showing an operation of a rear side guide of the sheet cassette of the image forming apparatus according to the first embodiment of the present invention.

An operation of the rear side guide 122 with the configuration described above will be explained next. FIG. 4 is a schematic sectional view showing the operation of the rear side guide 122 of the sheet cassette 101 of the image forming apparatus 100 according to the first embodiment of the present invention.

In the first embodiment, when the operator tries to place the recording sheets in the sheet cassette 101, first, the operator pulls out the sheet cassette 101 shown in FIG. 2 from the main body of the image forming apparatus 100 (refer to FIG. 1) in the arrow direction B. At this moment, the sheet cassette 101 including the rear side guide 122 is exposed outside the image forming apparatus 100. In the next step, the operator operates the operation lever 127 of the rear side guide 122, so that the engaging portion 126*a* of the lock member 126 is separated and disengaged from the rack 121 as shown in FIG. 5(*a*). Then, the operator slides and moves the rear side guide 122 to the desirable position corresponding to a desirable sheet size.

After the operator slides and moves the rear side guide 122 to the desirable position, when the operator releases the operation lever 127, the engaging portion 126*a* of the lock member 126 engages with the rack 121 once again with the urging force of the coil spring 128. As a result, it is possible to lock the lock member 126 at the desirable position, and restrict the movement of the rear side guide 122 within the play amount d (the small attachment gap) at the desirable position.

Further, after the operator slides and moves the rear side guide 122 to the desirable position, the operator places the recording sheets in a stacked state on the specific area of the sheet cassette 101 while the rear edge guide 124, the rear side guide 122, and the front side guide 123 guide the recording sheets.

After the operator places the recording sheets in the sheet cassette 101, the operator pushes the sheet cassette 101 in the insertion direction or the arrow direction C, so that the sheet cassette 101 is attached to the main body of the image forming apparatus 100 at the standard attachment position thereof. At this moment, the sheet cassette 101 abuts against a stopper (not shown), so that the further movement of the sheet cassette 101 is restricted at the standard attachment position.

In the first embodiment, when the sheet cassette 101 abuts against the stopper, the rear side guide 122 of the sheet cassette 101 receives a large force, that is, an impact upon attachment of the sheet cassette 101, in the arrow direction C through a moment of the recording sheets retained in the sheet cassette 101 in the stacked state. Accordingly, the rear side guide 122 is shifted in the arrow direction C by the play amount d (the small attachment gap) relative to the lock member 126 that is locked through the urging force of the coil spring 128. As a result, as shown in FIG. 4, the abutting portion 122*e* of the rear side guide 122 abuts against and pushes the abutting inclined surface 126*c* of the lock member 126. At the moment, a component force of the pressure is generated downwardly in an arrow direction G according to the inclination angle of the abutting inclined surface 126*c*, so that the lock member 126 is pushed against the bottom surface 101*a* of the sheet cassette 101.

Accordingly, when the sheet cassette 101 with the recording sheets retained therein in the stacked state is attached to the main body of the image forming apparatus 100, the rear side guide 122 receives the component force in the arrow direction C (the insertion direction) through the moment of the recording sheets and the like. With the component force, the engaging portion 126*a* of the lock member 126 engages with the rack 121 formed on the main body of the sheet cassette 101 with the engaging force that is increased from that generated with the urging force of the coil spring 128. As a result, it is possible to restrict the lock member 126 from being disengaged, thereby preventing the rear side guide 122 from being shifted.

As explained above, in the sheet cassette 101, the coil spring 128 generates the urging force as the initial position restriction force of the rear side guide 122 that regulates the recording sheets, so that the engaging portion 126*a* of the lock member 126 engages with the rack 121 formed on the main body of the sheet cassette 101 with the engaging force (the locking force). In the first embodiment, the sheet cassette 101 is configured such that it is possible to obtain the sufficient engaging force (the locking force) without setting the engaging force at an excessively high level. Accordingly, it is possible to secure the positional accuracy of the recording sheets without sacrificing the operability of the sheet cassette 101.

Second Embodiment

Figure 6:
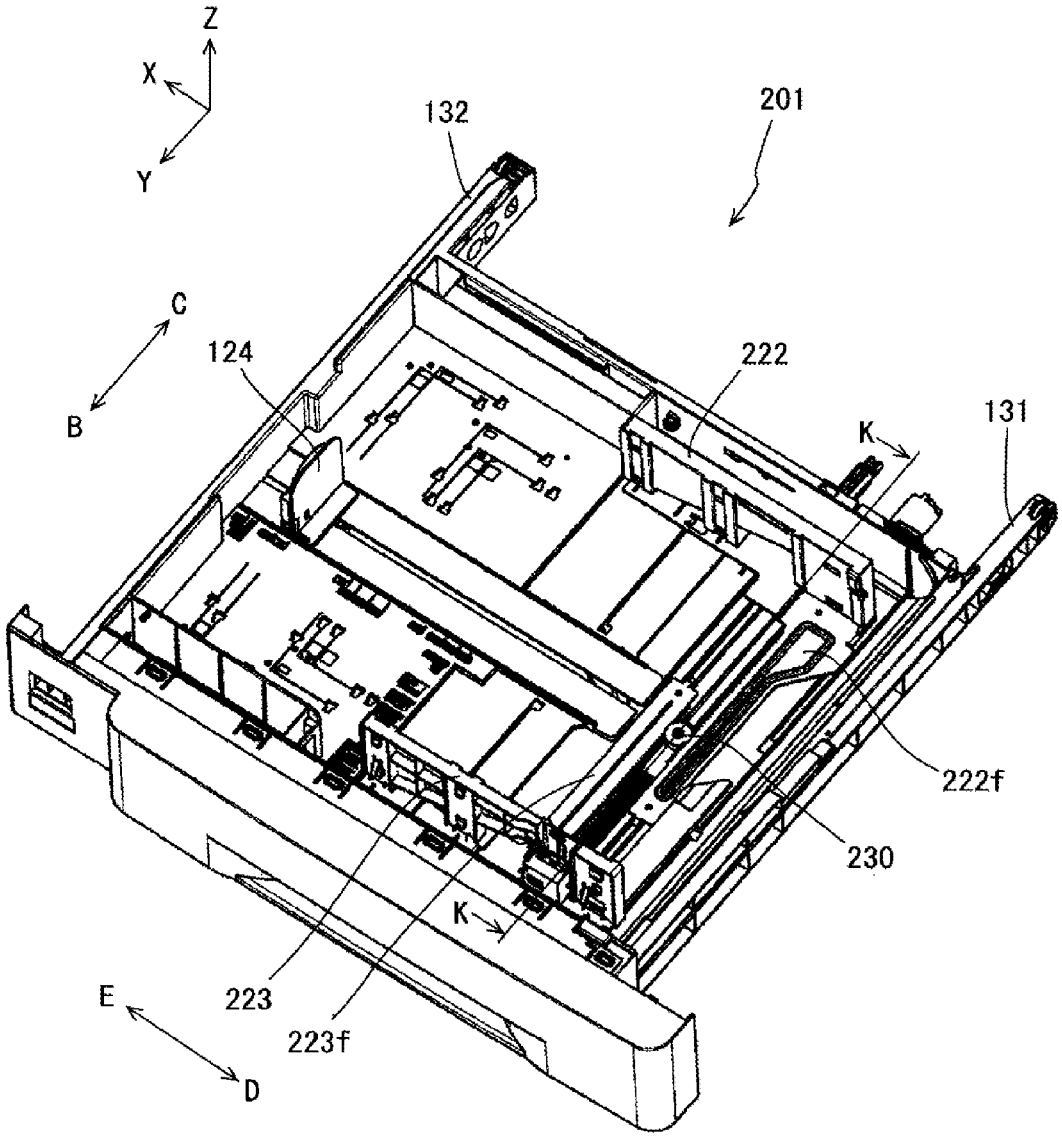
FIG. 6 is a schematic perspective view showing a sheet cassette of an image forming apparatus according to a second embodiment of the present invention.
Figure 7:
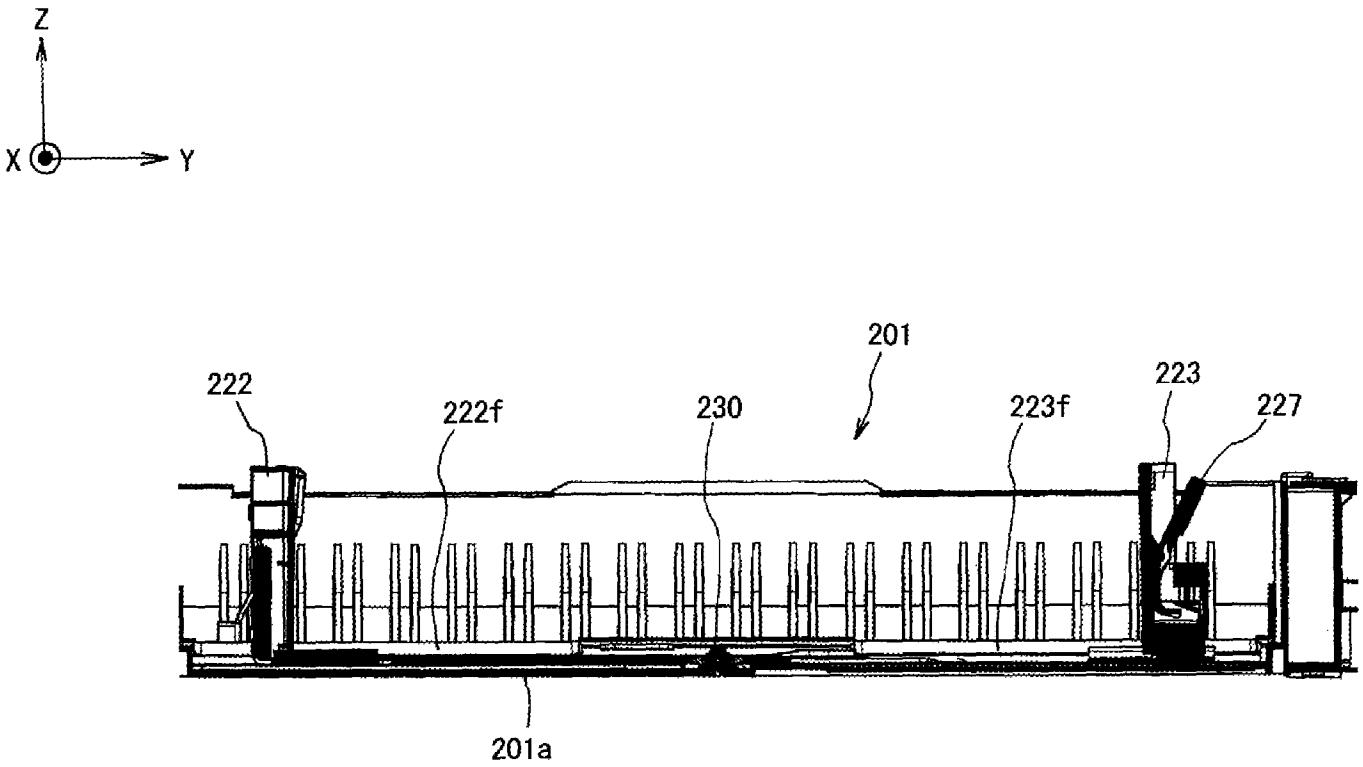
FIG. 7 is a schematic sectional view showing the sheet cassette of the image forming apparatus taken along a line K-K in FIG. 6 according to the second embodiment of the present invention.
Figure 8:
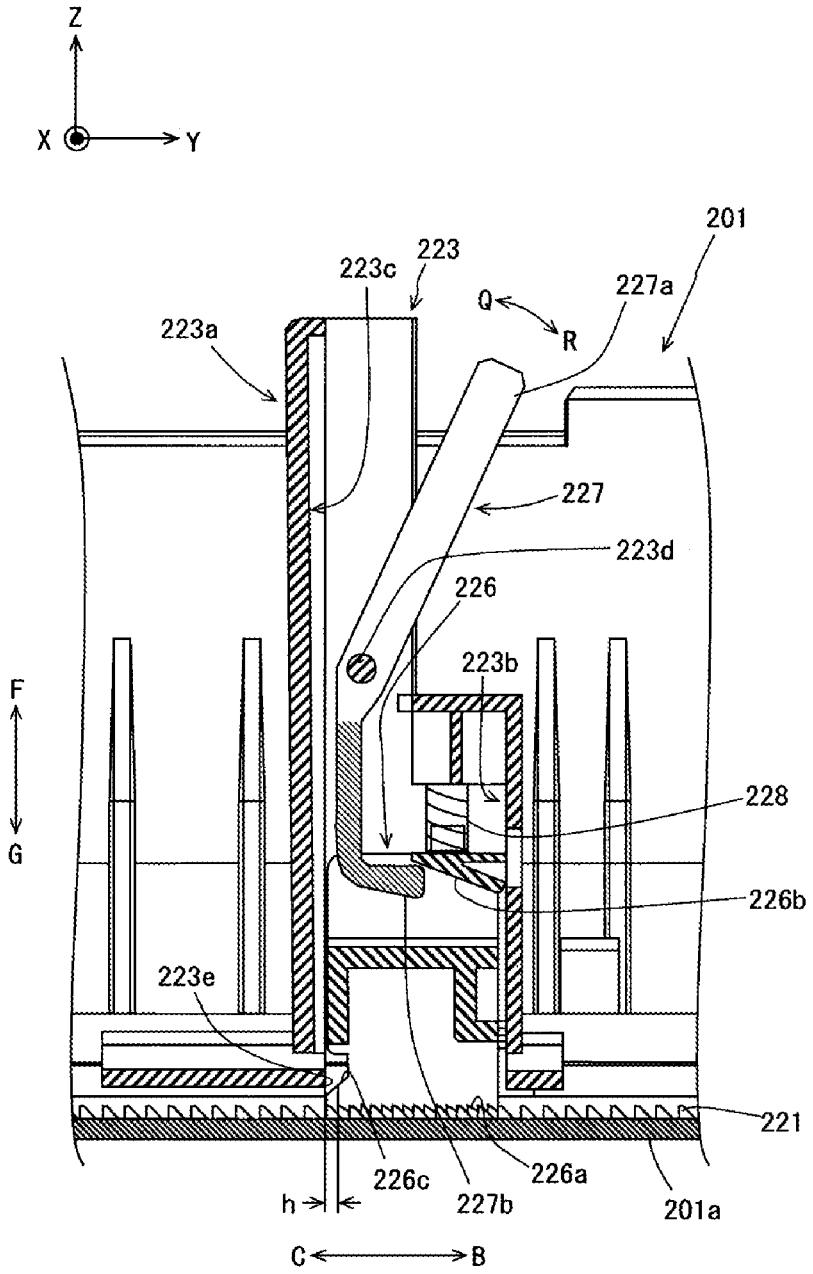
FIG. 8 is a schematic partially enlarged sectional view showing the sheet cassette of the image forming apparatus according to the second embodiment of the present invention.

A second embodiment of the present invention will be explained next. FIG. 6 is a schematic perspective view showing a sheet cassette 201 of the image forming apparatus 100 according to the second embodiment of the present invention. FIG. 7 is a schematic sectional view showing the sheet cassette 201 of the image forming apparatus 100 taken along a line K-K in FIG. 6 according to the second embodiment of the present invention. FIG. 8 is a schematic partially enlarged sectional view showing the sheet cassette 201 of the image forming apparatus 100 according to the second embodiment of the present invention. It should be noted that the sheet placing plate 125 of the sheet cassette 201 (refer to FIG. 2) is omitted in FIG. 6, so that an internal configuration of the sheet cassette 201 is clearly visible.

In the second embodiment, different from the sheet cassette 101 in the first embodiment shown in FIG. 2, the sheet cassette 201 of the image forming apparatus 100 includes a rear side guide 222 and a front side guide 223. The rear side guide 222 and the front side guide 223 are configured to slide and move together. Further, the front side guide 223 includes a locking mechanism having a lock member 226. Accordingly, in the second embodiment, components of the image forming apparatus 100 similar to those of the image forming apparatus 100 in the first embodiment (refer to FIG. 1) are designated with the same reference numerals, and the drawings and the explanations thereof are omitted, so that different features are mainly explained. Further, it should be noted that a main configuration of the image forming apparatus 100 in the second embodiment is similar to that of the image forming apparatus 100 shown in FIG. 1, and FIG. 1 is referred to as necessary in the following description.

As shown in FIG. 6, the sheet cassette 201 includes the rear side guide 222 for guiding the rear side of the recording sheet to be placed in the pullout direction of the sheet cassette 201 (the arrow direction B), and the front side guide 223 for guiding the front side of the recording sheet in the arrow direction B. Further, the sheet cassette 201 holds the rear side guide 222 and the front side guide 223 to be slidable in the Y axis direction.

In the second embodiment, the rear side guide 222 includes a rack portion 222*f* at a lower portion of the sheet placing plate 125 (refer to FIG. 1), and the rack portion 223*f* extends in the arrow direction B. Similarly, the front side guide 223 includes a rack portion 223*f* at the lower portion of the sheet placing plate 125 (refer to FIG. 1), and the rack portion 223*f* extends in the arrow direction C. The rack portion 222*f* and the rack portion 223*f* extend in parallel with a pinion gear 230 in between. The pinion gear is held on a bottom surface 201*a* of the sheet cassette 201 (refer to FIG. 7) to be freely rotatable. Further, the rack portion 222*f* and the rack portion 223*f* respectively include teeth portions 222*g* and 223*g* (refer to FIG. 9) engaging with the pinion gear 201*a* and formed on opposite sides of the rack portion 222*f* and the rack portion 223*f*. Accordingly, the rack portion 222*f* and the rack portion 223*f* constitute the link mechanism formed of a rack-and-pinion configuration.

Figure 9:
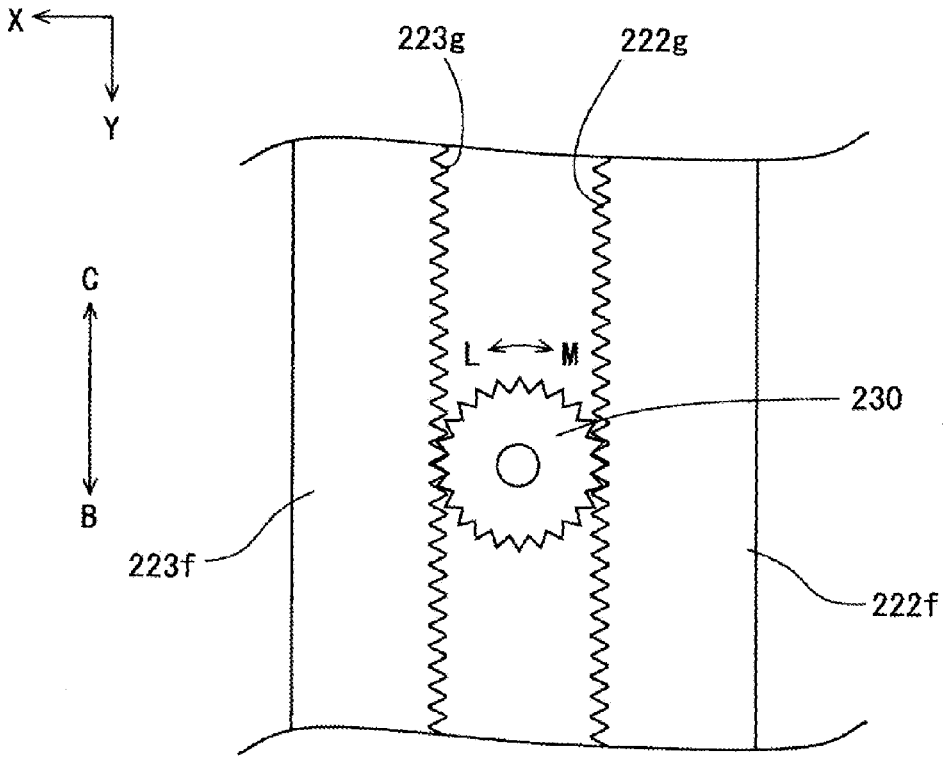
FIG. 9 is a schematic side view showing a link mechanism of the sheet cassette of the image forming apparatus according to the second embodiment of the present invention.

FIG. 9 is a schematic side view showing the link mechanism formed of the rack-and-pinion configuration of the sheet cassette 201 of the image forming apparatus 100 according to the second embodiment of the present invention. As shown in FIG. 9, the link mechanism is formed of the rack portion 22*f*, the rack portion 223*f* and the pinion gear 230.

In the second embodiment, when the operator moves the front side guide 223 in the arrow direction C, the rack portion 223*f* is moved in the arrow direction C, so that the pinion gear 230 is rotated in an arrow direction M. As a result, the rack portion 222*f*, that is, the rear side guide 222, is moved by the same amount in the arrow direction B. Similarly, when the operator moves the front side guide 223 in the arrow direction B, the pinion gear 230 is rotated in an arrow direction L. As a result, the rear side guide 222 is moved by the same amount in the arrow direction C.

A locking mechanism of the rear side guide 122 will be explained next. As shown in FIG. 7, the front side guide 223 is provided with an operation lever 227 for operating the locking mechanism. FIG. 8 is the schematic partially enlarged sectional view showing the sheet cassette 201 taken along a plane passing through the operation lever 227 and viewed from an arrow direction K (the positive side of the X axis).

As shown in FIG. 8, the main body of the sheet cassette 201 holds the front side guide 223 to be slidable in the arrow direction C and the arrow direction B (the Y axis direction), and includes a bottom surface 201*a*. Further, a rack 221 is formed on the bottom surface 201*a*, and includes a teeth portion with a specific pitch p1 arranged in the arrow direction C and the arrow direction B (the Y axis direction).

In the second embodiment, the front side guide 223 includes a lock member 226 on an opposite side to the guide side where a regulating surface 223*a* is formed for regulating the front side of the recording sheet. The lock member 226 is integrally formed of an engaging portion 226*a* disposed at a lower portion thereof and an application surface 226*b* disposed at an upper portion thereof. Further, the front side guide 223 is configured to hold the lock member 226 with a guide portion including a guide surface 223*b* and a guide surface 223*c* facing oppositely each other, so that the lock member 226 can slide in the arrow direction F and the arrow direction G, that is, the vertical direction.

In the second embodiment, the small attachment gap (the play amount d) is formed between the guide surface 223*b* and the guide surface 223*c*, and the lock member 226 in the arrow direction B and the arrow direction C. Further, a coil spring 228 is disposed between the main body of the front side guide 223 and the lock member 226 in a compressed state, so that the coil spring 228 urges the lock member 226 in the arrow direction G (the downward direction). Accordingly, the rack 121 disposed on the main body of the sheet cassette 201 engages with the engaging portion 226*a* of the lock member 226, so that the lock member 226 is locked to the main body of the sheet cassette 201. As a result, the main body of the front side guide 223 is restricted in a movement thereof within the play amount d (the small attachment gap).

In the second embodiment, the relationship between the rack 121 and the engaging portion 226*a* of the lock member 226 is similar to that between the rack 121 and the engaging portion 126*a* of the lock member 126 in the first embodiment explained with reference to FIG. 5, except that the shape of the teeth portion is reversed right to left. Accordingly, an explanation thereof is omitted. It should be noted that the relationship of the pitch p1 and the pitch p2 is identical.

In the second embodiment, the front side guide 223 further includes the operation lever 227 capable of engaging with the lock member 226, and the operation lever 227 is supported with a rotational axis 223*d* thereof to be freely rotatable. The operational lever 227 includes an operation portion 227*a* and an application portion 227*b*. When the operation lever 227 is supported to be freely rotatable in an initial state shown in FIG. 8, the operation portion 227*a* extends obliquely and upwardly from the rotational axis 223*d*, and the application portion 227*b* extends downwardly from the rotational axis 223*d*. The application portion 227*b* is formed to bend at a middle portion thereof, so that the application portion 227*b* can engage with the application surface 226*b* of the lock member 226 from below.

In the second embodiment, when the operator operates and rotates the operation portion 227*a* of the operation lever 227 in an arrow direction Q while the front side guide 223 is in the initial state shown in FIG. 8, the operation lever 227 is rotated in the arrow direction Q, so that the application portion 227*b* of the operation lever 227 pushes the application surface 226*b* of the lock member 226 from below. Accordingly, the lock member 226 is pushed upwardly (the arrow direction F) against the urging force of the coil spring 228. As a result, the engaging portion 226*a* of the lock member 226 is disengaged from the rack 121 (refer to FIG. 5(*a*)).

Accordingly, from this state, when the operator moves the front side guide 223 to a desirable position along the arrow direction B and the arrow direction C, and releases the operation lever 227, the engaging portion 226*a* of the lock member 226 engages with the rack 121 once again. As a result, it is possible to lock the lock member 226 at the desirable position, and restrict the movement of the front side guide 223 within the play amount d (the small attachment gap) at the desirable position. At this moment, as explained above, together with the movement of the front side guide 223 in the Y axis direction, the rear side guide 222 is moved by the same amount in the opposite direction.

In the second embodiment, as shown in FIG. 8, the lock member 226 includes a recessed portion having an abutting inclined surface 226*c* on a side portion thereof on the insertion side (the arrow direction C) at a position near the engaging portion 226*a*. The abutting inclined surface 226*c* is formed to incline in the arrow direction B (the opposite direction to the arrow direction C) from below toward upward. Further, the front side guide 223 includes an abutting portion 223*e* on the rear side thereof at a lower portion of the guide surface 222*c*. The abutting portion 223*e* is arranged to face and be able to abut against the abutting inclined surface 226*c*.

In the second embodiment, as explained above, the abutting portion 223*e* is arranged to be able to abut against the abutting inclined surface 226*c* at an abutting position thereof. The maximum distance h is set between the abutting portion 223*e* and the abutting position of the abutting inclined surface 226*c*, and it is configured such that the maximum distance h becomes substantially equal to or slightly smaller than the play amount d (the small attachment gap).

In the second embodiment, it is preferable that the abutting inclined surface 226*c* is inclined at an inclination angle of about 40° to 45° (the inclination angle is 45° in the second embodiment). Further, it is preferable that the maximum distance h is set to be smaller than the pitch p2 of the engaging portion 226*a* that corresponds to the positional accuracy of the lock member 226.

An operation of the front side guide 223 with the configuration described above will be explained next.

In the second embodiment, when the operator tries to place the recording sheets in the sheet cassette 201, first, the operator pulls out the sheet cassette 201 shown in FIG. 6 from the main body of the image forming apparatus 100 (refer to FIG. 1) in the arrow direction B. At this moment, the sheet cassette 201 including the rear side guide 222 is exposed outside the image forming apparatus 100. In the next step, the operator operates the operation lever 227 of the front side guide 223, so that the engaging portion 226*a* of the lock member 226 is separated and disengaged from the rack 121 (refer to FIG. 5(*a*)). Then, the operator slides and moves the front side guide 223 to the desirable position corresponding to a desirable sheet size. At this moment, the rear side guide 222 is also moved to the opposite direction with the link mechanism described above.

After the operator slides and moves the front side guide 223 to the desirable position, when the operator releases the operation lever 227, the engaging portion 226*a* of the lock member 226 engages with the rack 121 once again with the urging force of the coil spring 228. As a result, it is possible to lock the lock member 226 at the desirable position, and restrict the movement of the front side guide 223 within the play amount d (the small attachment gap) at the desirable position.

Further, after the operator slides and moves the front side guide 223 to the desirable position, the operator places the recording sheets in a stacked state on the specific area of the sheet cassette 201 while the rear edge guide 124, the rear side guide 222, and the front side guide 223 guide the recording sheets.

After the operator places the recording sheets in the sheet cassette 201, the operator pushes the sheet cassette 201 in the insertion direction or the arrow direction C, so that the sheet cassette 201 is attached to the main body of the image forming apparatus 100 at the standard attachment position thereof. At this moment, the sheet cassette 201 abuts against a stopper (not shown), so that the further movement of the sheet cassette 201 is restricted at the standard attachment position.

In the second embodiment, when the sheet cassette 201 abuts against the stopper, the rear side guide 222 of the sheet cassette 201 receives a large force, that is, an impact upon attachment of the sheet cassette 201, in the arrow direction C through a moment of the recording sheets retained in the sheet cassette 201 in the stacked state. As a result, the rear side guide 222 tries to move in the arrow direction. Further, the front side guide 223 receives the large force in the arrow direction B through a force transmitted through the link mechanism shown in FIG. 9.

At this moment, the front side guide 223 is shifted in the arrow direction B by the play amount d (the small attachment gap) relative to the lock member 226 that is locked through the urging force of the coil spring 228. As a result, the abutting portion 223*e* of the front side guide 223 abuts against and pushes the abutting inclined surface 226*c* of the lock member 226. At the moment, a component force of the pressure is generated downwardly in the arrow direction G according to the inclination angle of the abutting inclined surface 226*c*, so that the lock member 226 is pushed against the bottom surface 201*a* of the sheet cassette 201.

Accordingly, when the sheet cassette 201 with the recording sheets retained therein in the stacked state is attached to the main body of the image forming apparatus 100, the front side guide 223 receives the component force in the arrow direction B (the pullout direction) through the moment of the recording sheets and the like. With the component force, the engaging portion 226*a* of the lock member 226 engages with the rack 121 formed on the main body of the sheet cassette 201 with the engaging force that is increased from that generated with the urging force of the coil spring 228. As a result, it is possible to restrict the lock member 226 from being disengaged, thereby preventing the front side guide 223 and the rear side guide 222 that are moved together through the link mechanism from being shifted.

As explained above, in the sheet cassette 201, the coil spring 228 generates the urging force as the initial position restriction force of the front side guide 223 that regulates the recording sheets, so that the engaging portion 226*a* of the lock member 226 engages with the rack 121 formed on the main body of the sheet cassette 201 with the engaging force (the locking force). In the second embodiment, the sheet cassette 101 is configured such that it is possible to obtain the sufficient engaging force (the locking force) without setting the engaging force at an excessively high level. Accordingly, it is possible to secure the positional accuracy of the recording sheets without sacrificing the operability of the sheet cassette 201. Further, the operation lever 227 of the front side guide 223 is disposed on the front side of the image forming apparatus 100. Accordingly, it is possible to further improve the operability of the sheet cassette 201.

In the first embodiment and the second embodiment described above, the present invention is applied to the electro-photographic printer, and is not limited thereto. The present invention may be applicable to an MFP (Multi Function Printer), a facsimile, a copier, and the like.

The disclosure of Japanese Patent Application No. 2013-151737, filed on Jul. 22, 2013, is incorporated in the application.

While the invention has been explained with reference to the specific embodiments of the invention, the explanation is illustrative and the invention is limited only by the appended claims.

What is claimed is:

1. A medium cassette to be attached to a main body of an image forming apparatus so that the medium cassette slides in an insertion direction or a pullout direction relative to the image forming apparatus, comprising:

a rear side guide for guiding a medium to be placed at a rear side in the pullout direction;

a locking member disposed to be able to engage with a body of the medium cassette for regulating a position of the rear side guide relative to the body of the medium cassette; and a movement conversion member for converting a movement of the rear side guide generated by an impact when the medium cassette is attached to the main body of the image forming apparatus to a movement of the locking member in a direction that the locking member engages with the body of the medium cassette, wherein said locking member includes an engaging portion at a position where the engaging portion can engage with the body of the medium cassette, said engaging portion includes a first teeth portion having a first pitch, said body of the medium cassette includes a rack extending in the insertion direction thereof and capable of engaging with the engaging portion, said rack includes a second teeth portion having a second pitch greater than the first pitch, and said engaging portion is arranged so that a plurality of teeth of the first teeth portion is situated between two teeth of the second teeth portion of the rack.

2. The medium cassette according to claim 1, wherein said locking member is urged in a direction that the engaging portion engages with the rack.

3. The medium cassette according to claim 1, wherein said rear side guide is arranged to hold the locking member so that the locking member can be separated from and attached to the body of the medium cassette.

4. The medium cassette according to claim 1, further comprising:

a front side guide for guiding a front side of the medium in the pullout direction; and a link mechanism, wherein said link mechanism includes a first rack portion formed on the rear side guide and a second rack portion formed on the front side guide, and said first rack portion is arranged to face the second rack portion and engage with a pinion gear disposed on the body of the sheet cassette.

5. The medium cassette according to claim 3, wherein said movement conversion member includes an abutting inclined surface formed on the locking member and being inclined relative to a movement direction of the rear side guide upon the impact, and said movement conversion member further includes an abutting portion formed on the rear side guide and pushing the abutting inclined surface through the movement of the rear side guide generated by the impact.

6. The medium cassette according to claim 4, wherein said movement conversion member includes an abutting inclined surface formed on the locking member and being inclined relative to a movement direction of the front side guide upon the impact, and said movement conversion member further includes an abutting portion formed on the front side guide and pushing the abutting inclined surface through a movement of the front side guide generated by the impact.

7. The medium cassette according to claim 3, further comprising an operation lever supported on the rear side guide to be freely rotatable, wherein said operation lever includes an operation portion and an application portion, and said application portion is arranged to move the locking member away from the body of the sheet cassette when the operation portion is operated.

8. The medium cassette according to claim 4, further comprising an operation lever supported on the front side guide to be freely rotatable, wherein said operation lever includes an operation portion and an application portion, and said application portion is arranged to move the locking member away from the body of the sheet cassette when the operation portion is operated.

9. An image forming apparatus comprising the medium cassette according to claim 1.

* * * * *